US006717564B2

(12) United States Patent
Albu et al.

(10) Patent No.: US 6,717,564 B2
(45) Date of Patent: Apr. 6, 2004

(54) RLCD TRANSCONDUCTANCE SAMPLE AND HOLD COLUMN BUFFER

(75) Inventors: Lucian R. Albu, New York, NY (US); Peter J. Janssen, Scarborough, NY (US)

(73) Assignee: Koninklijke Philips Electronics N.V., Eindhoven (NL)

( * ) Notice: Subject to any disclaimer, the term of this patent is extended or adjusted under 35 U.S.C. 154(b) by 0 days.

(21) Appl. No.: 10/241,107

(22) Filed: Sep. 11, 2002

(65) Prior Publication Data

US 2003/0011554 A1 Jan. 16, 2003

Related U.S. Application Data

(63) Continuation-in-part of application No. 09/537,824, filed on Mar. 29, 2000.

(51) Int. Cl.[7] ..... G09G 3/36

(52) U.S. Cl. ..... 345/98; 345/87

(58) Field of Search ..... 345/98, 92, 100, 345/87, 90, 93, 63, 77, 89, 147; 359/59; 327/530; 342/138; 340/793, 767; 358/241, 236

(56) References Cited

U.S. PATENT DOCUMENTS

| | | | | | |
|---|---|---|---|---|---|
| 5,459,483 | A | * | 10/1995 | Edwards | 345/98 |
| 6,091,390 | A | * | 7/2000 | Sim | 345/98 |
| 6,148,048 | A | * | 11/2000 | Kerth et al. | 375/350 |
| 6,369,853 | B1 | * | 4/2002 | Merrill et al. | 348/302 |
| 6,476,864 | B1 | * | 11/2002 | Borg et al. | 348/245 |
| 6,489,904 | B1 | * | 12/2002 | Hisano | 341/120 |
| 6,512,544 | B1 | * | 1/2003 | Merrill et al. | 348/302 |

* cited by examiner

*Primary Examiner*—Vijay Shankar
*Assistant Examiner*—Nitin Patel

(57) ABSTRACT

A column driving arrangement for an RLCD device isolates the source of a ramp voltage corresponding to gray-scale levels from the sample-and-hold gates of the individual columns. Preferably, this isolation is provided by an operational transconductance amplifier (OTA) at each column that provides a controlled current for charging the column capacitance to the appropriate gray-scale voltage level. The capacitor effects an integration of the current, thereby providing a noise-filtering effect. Additionally, each column capacitance is individually discharged, thereby obviating the need for a common high-current discharge device.

13 Claims, 1 Drawing Sheet

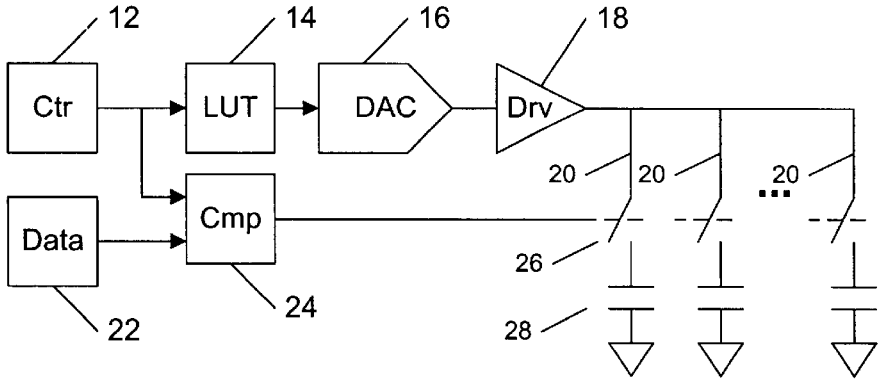
FIG. 1 [Prior Art]
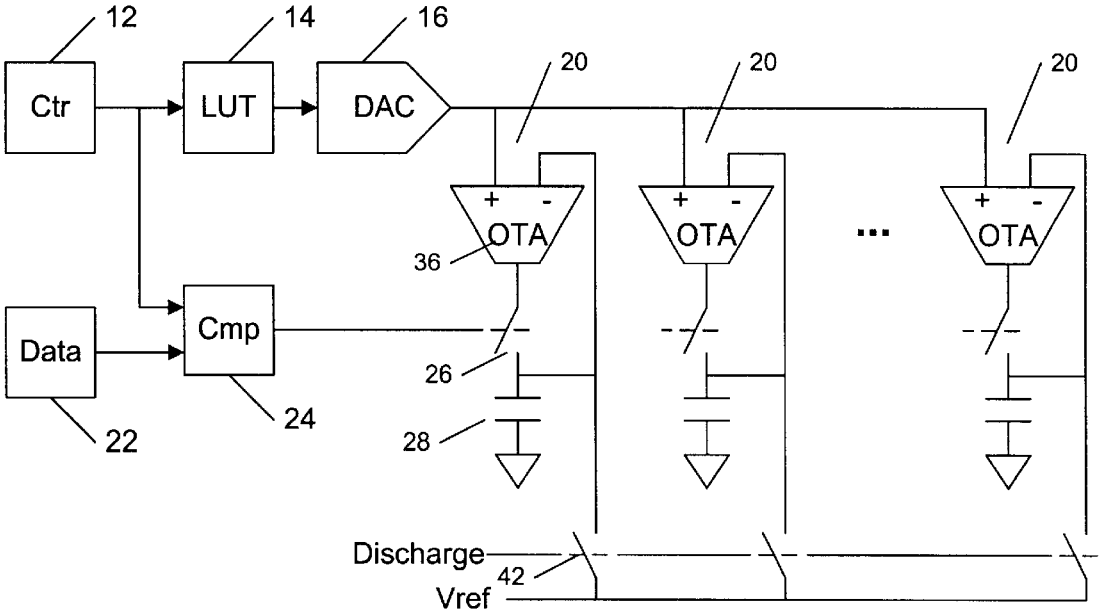
FIG. 2

RLCD TRANSCONDUCTANCE SAMPLE AND HOLD COLUMN BUFFER

This application is a continuation-in-part of U.S. patent application Ser. No. 09/537,824, filed Mar. 29, 2000.

TECHNICAL FIELD

This invention pertains to the field of electronic circuits for driving reflective liquid crystal displays (RLCD).

BACKGROUND AND SUMMARY OF THE INVENTION

In an RLCD having a matrix of m horizontal rows and n vertical columns, each m-n intersection forms a cell or picture element (pixel). By applying an electric potential difference, such as 7.5 volts (v), across a cell, a phase change occurs in the crystalline structure at the cell site causing the pixel to change the incident light polarization vector orientation, thereby blocking the light from emerging from the electro-optical system. Removing the voltage across the pixel causes the liquid crystal in the pixel structure to return to the initial "bright" state. Variations in the applied voltage level produce a plurality of different gray shades between the light and dark limits.

FIG. 1 illustrates an example block diagram of a conventional column driving arrangement for an RLCD device. A column driver 18 provides a ramp voltage to each of a plurality of column lines 20, progressively applying a voltage corresponding to each gray-scale level. A counter 12 sequentially progresses through each gray-scale value, typically 0–256, although other levels of gray-scale resolution may be provided. A look-up-table LUT 14 maps each gray-scale value to a voltage that corresponds to this value; this mapping is a function of the particular RLCD, and is typically non-linear. The voltage value is converted to an analog voltage level by a digital-to-analog converter (DAC) 16, and this analog voltage provides the input to the driver 18. As discussed further below, the driver 18 is typically a high-current device.

The load that each column line 20 presents to the driver 18 is represented as a capacitance 28, which represents the sum of the capacitances of the individual pixels in the column and the capacitance of the lines to these pixels. Each column line 20 includes a switch 26 that serves as a sample-and-hold gate, wherein the capacitance 28 serves as the "hold" storage element. Each column switch 26 is controlled by a comparator 24 that compares the current count of the counter 12 to the desired gray-scale level for the column, which is stored in a data memory 22. When the count from the counter 12 reaches the desired gray-scale level for the column, the comparator 24 opens the switch 26, placing the capacitance 28 in the hold-state, holding the current value of the ramp voltage from the driver 18. Not illustrated, a row-controller subsequently applies the voltage on the capacitance 28 to the pixel at the intersection of the column and the selected row.

At the end of each row-cycle, all of the capacitances 28 are discharged and the above process is repeated. Because this discharge must occur quickly (typically within 30 nanoseconds), and must discharge all of the capacitances 28 (typically 5–10 nanofarads), the peak current of the discharge can be as high as a few amperes. In a conventional RLCD, the driver 18 is configured to provide this high-current capacity.

A number of drawbacks can be attributed to the conventional RLCD column driver arrangement of FIG. 1. As noted above, the driver 18 must be configured to accommodate a high discharge current. Additionally, when each switch 26 is opened, a transient is fed back to the driver 18 from the gate of the switch 26. This transient can be substantial, particularly when a large number of switches 26 open simultaneously, such as when a line segment of uniform gray-scale is being displayed. This transient modifies the voltage level from the driver 18, causing it to differ from the voltage provided by the LUT 14 corresponding to the current gray-scale value in the counter 12. Any columns that have not yet entered the hold-state will receive this erroneous voltage, and will display an improper gray-scale level. This transient effect is commonly termed "horizontal crosstalk". Further, the common connection of multiple column lines 20 to the driver 28 provides a substantial "antenna", and is susceptible to noise transients as well.

In this invention, a column driving arrangement for an RLCD device is provided that isolates the source of a ramp voltage corresponding to gray-scale levels from the sample-and-hold gates of the individual columns. Preferably, this isolation is provided by an operational transconductance amplifier (OTA) at each column that provides a controlled current for charging the column capacitance to the appropriate gray-scale voltage level. The capacitor effects an integration of the current, thereby providing a noise-filtering effect. Additionally, a each column capacitance is individually discharged, thereby obviating the need for a common high-current discharge device.

BRIEF DESCRIPTION OF THE DRAWINGS

The invention is explained in further detail, and by way of example, with reference to the accompanying drawings wherein:

FIG. 1 illustrates an example block diagram of a conventional column driving arrangement for an RLCD.

FIG. 2 illustrates an example block diagram of a column driving arrangement for an RLCD in accordance with this invention.

Throughout the drawings, the same reference numerals indicate similar or corresponding features or functions.

DETAILED DESCRIPTION

FIG. 2 illustrates an example block diagram of a column driving arrangement for an RLCD in accordance with this invention.

As contrast to the conventional column driving arrangement of FIG. 1, each column line 20 includes an operational transconductance amplifier (OTA) 36 that is placed in series between a source 16 of the gray-scale ramp voltage and the corresponding sample-and-hold switch 26 for the column 20. This OTA 36 receives a differential voltage input and provides a current output. One of the differential input pair to the OTA 36 is connected to the gray-scale ramp voltage, and the other of the differential input pair is connected to the column capacitance 28. The capacitance 28 effects an integration of the current from the OTA 36, thereby providing a first level filter effect that reduces the noise sensitivity of the RLCD.

Preferably, the OTA 36 is a high-gain device, thereby providing substantial isolation between the switch 26 and the gray-scale ramp voltage from device 16. The high-gain of the OTA 36 and the feedback of the capacitance voltage from capacitance 28 also assures that the capacitance voltage from capacitance 28 substantially equals the gray-scale ramp voltage when the switch 26 is closed. When, as in the conventional column driving arrangement, the count from the counter 12 matches the intended gray-scale value in memory 22, the comparator 24 opens switch 26, and the capacitance 28 retains the current gray-scale ramp voltage.

Also illustrated in FIG. 2, a switch 42 is associated with each column line, and serves to discharge the capacitance 28 to a reference voltage level at the end of each row-cycle. Because the switch 42 is associated with a single column capacitance 28, the peak discharge current is substantially less than that of the conventional column driving arrangement of FIG. 1, and therefore the switch 42 need not be a high-current device.

Because the source of the gray-scale ramp voltage in the arrangement of FIG. 2 merely provides a voltage to a high impedance input of each of the OTAs 36, and does not need to provide a high-current discharge capacity, the need for a high-current driver 18 of FIG. 1 is eliminated in the arrangement of FIG. 2. In a typical embodiment, the output of the DAC 16 is sufficient to supply the gray-scale ramp voltage to each of the OTAs 36, as illustrated in FIG. 2. Optionally, a separate driver may be provided to buffer the output of the DAC 16, but this driver need not be a high-current capacity driver.

Because the OTAs 36 provides substantial isolation from the switches 26, any transients from the switches are substantially attenuated before being fed back to the source 16 of the gray-scale ramp voltage, thereby minimizing horizontal crosstalk.

The foregoing merely illustrates the principles of the invention. It will thus be appreciated that those skilled in the art will be able to devise various arrangements which, although not explicitly described or shown herein, embody the principles of the invention and are thus within its spirit and scope. For example, the circuit arrangement of FIG. 2 illustrates an OTA 36 at each column line 20. One of ordinary skill in the art will recognize that alternative isolation devices may also be employed. For example, a conventional voltage buffer may be used, although it would not provide the integration and filtering benefits that a current output provides, as discussed above. In like manner, the switch 42 at each column capacitance 28 may be provided to avoid the need for a high-current discharge path, independent of the presence or type of isolation device that is provided. These and other system configuration and optimization features will be evident to one of ordinary skill in the art in view of this disclosure, and are included within the scope of the following claims.

We claim:

1. A column driving arrangement comprising:

a source device that is configured to provide a voltage corresponding to a gray-scale level; and a plurality of column lines, operably coupled to the source device, that are each configured to receive the voltage corresponding to the gray-scale level, each column line of the plurality of column lines including a capacitance, a switch, operably coupled to the capacitance, that controls coupling between the voltage corresponding to the gray-scale level and the capacitance, and an isolation device that isolates the source device from the switch, wherein the isolation device includes an operational transconductance amplifier.

2. The arrangement of claim 1, wherein the operational transconductance amplifier includes a differential input that is configured to receive the voltage corresponding to the gray-scale level and a second voltage corresponding to voltage at the capacitance, and a current output that is configured to provide current to the capacitance.

3. The arrangement of claim 1, wherein the operational transconductance amplifier is configured to provide high gain between the differential input and the current output.

4. A column driving arrangement comprising:

a source device that is configured to provide a voltage corresponding to a gray-scale level; and a plurality of column lines, operably coupled to the source device, that are each configured to receive the voltage corresponding to the gray-scale level, each column line of the plurality of column lines including a capacitance, a switch, operably coupled to the capacitance, that controls coupling between the voltage corresponding to the gray-scale level and the capacitance, and an isolation device that isolates the source device from the switch, wherein each column line further includes a memory that is configured to contain a desired gray-scale value for the column line, and a comparator, operably coupled to the memory and to the switch, that is configured to control the switch based on a comparison between the desired gray-scale value and the gray-scale level.

5. A column driving arrangement comprising:

a source device that is configured to provide a voltage corresponding to a gray-scale level;

a plurality of column lines, operably coupled to the source device, that are each configured to receive the voltage corresponding to the gray-scale level, each column line of the plurality of column lines including a capacitance, a switch, operably coupled to the capacitance, that controls coupling between the voltage corresponding to the gray-scale level and the capacitance, and an isolation device that isolates the source device from the switch;

a counter that is configured to provide a count that corresponds to the gray-level; and a look-up-table, operably coupled to the counter, that is configured to provide a value corresponding to the count, wherein the source device is operably coupled to the look-up-table, and is configured to receive the value from the look-up-table, and to provide therefrom the voltage corresponding to the gray-scale level.

6. The arrangement of claim 5, wherein each column line further includes a memory that is configured to contain a desired gray-scale value for the column line, and a comparator, operably coupled to the memory, to the switch, and to the counter, that is configured to control the switch based on a comparison between the desired gray-scale value and the count from the counter.

7. The arrangement of claim 5, wherein the source device includes a digital-to-analog converter.

8. A column driving arrangement comprising:

a source device that is configured to provide a voltage corresponding to a gray-scale level; and a plurality of column lines, operably coupled to the source device, that are each configured to receive the voltage corresponding to the gray-scale level, each column line of the plurality of column lines including a capacitance, a switch, operably coupled to the capacitance, that controls coupling between the voltage corresponding to the gray-scale level and the capacitance, and an isolation device that isolates the source device from the switch, wherein each column line further includes a discharge switch that is configured to discharge the capacitance.

9. A column driving arrangement comprising:

a source device that is configured to provide a voltage corresponding to a gray-scale level, a plurality of column lines, operably coupled to the source device, that are each configured to receive the voltage corresponding to the gray-scale level, each column line of the plurality of column lines including:

a capacitance, a first switch, operably coupled to the capacitance, that controls coupling between the voltage corresponding to the gray-scale level and the capacitance, and a second switch, operably coupled to the capacitance, that is configured to discharge the capacitance wherein each column line further includes an isolation device that is configured to isolate the first switch and the second switch from the source device.

10. A column driving arrangement comprising:

a source device that is configured to provide a voltage corresponding to a gray-scale level, a plurality of column lines, operably coupled to the source device that are each configured to receive the voltage corresponding the gray-scale level, each column line of the plurality of column lines including:

a capacitance, a first switch, operably coupled to the capacitance, that controls coupling between the voltage corresponding to the gray-scale level and the capacitance, and a second switch, operably coupled to the capacitance, that is configured to discharge the capacitance wherein the isolation device includes an operational transconductance amplifier.

11. The arrangement of claim 10, wherein the operational transconductance amplifier includes a first input that is operably coupled to the source device, a second input that is operably coupled to the capacitance and to the second switch, and an output that is operably coupled to the capacitance.

12. A method of controlling voltage levels of a plurality of column lines in an RLCD device, comprising:

generating a ramp voltage, providing the ramp voltage to each of a plurality of isolation devices associated with each of the column lines, generating a corresponding ramp voltage at each of the plurality of column lines via each of the plurality of isolation devices, selectively terminating the generating of the corresponding ramp voltage at each of the plurality of column lines to provide the voltage levels of the plurality of column lines, based on each of a plurality of data values associated with each of the column lines, and discharging the voltage levels of the plurality of column lines via each of a plurality of discharge switches associated with each of the column lines.

13. A method of controlling voltage levels of a plurality of column lines in an RLCD device, comprising:

generating a ramp voltage, providing the ramp voltage to each of a plurality of isolation devices associated with each of the column lines, generating a corresponding ramp voltage at each of the plurality of column lines via each of the plurality of isolation devices, and selectively terminating the generating of the corresponding ramp voltage at each of the plurality of column lines to provide the voltage levels of the plurality of column lines, based on each of a plurality of data values associated with each of the column lines, wherein generating the corresponding ramp voltage at each of the column lines includes:

generating a current at each of the column lines based on the ramp voltage, and providing the current to a capacitance associated with each of the plurality of column lines.

* * * * *